US006406207B1

(12) United States Patent
Wiegner et al.

(10) Patent No.: US 6,406,207 B1
(45) Date of Patent: Jun. 18, 2002

(54) PUMP FOR DISCHARGING DOSES OF LIQUID, GEL-LIKE OR VISCOUS SUBSTANCES

(75) Inventors: Georg Wiegner, Flat E. 14th Floor, Hilton Tower, 96 Granville Road, Tsimshatsui, Kowloon, Hong Kong; Hyeong Sook (Morin) Kim, Hong Kong, both of (CN)

(73) Assignee: Georg Wiegner, Kowloon (HK)

( * ) Notice: Subject to any disclaimer, the term of this patent is extended or adjusted under 35 U.S.C. 154(b) by 0 days.

(21) Appl. No.: 09/938,887

(22) Filed: Aug. 24, 2001

Related U.S. Application Data

(62) Division of application No. 09/254,770, filed on May 14, 1999.

(30) Foreign Application Priority Data

Jul. 10, 1997 (DE) ..... 19729516
Jul. 8, 1998 (WO) ..... PCT/EP98/04255

(51) Int. Cl.[7] ..... A46B 11/04

(52) U.S. Cl. ..... 401/272; 401/270; 401/188 R; 401/187; 222/207

(58) Field of Search ..... 401/272, 187, 401/188 R, 189, 270, 273, 278, 279, 183, 184, 185, 186; 222/207

(56) References Cited

U.S. PATENT DOCUMENTS 2,628,001 A * 2/1953 Sarnoff ..... 401/187
2,804,240 A 8/1957 Anderson
3,124,275 A 3/1964 Lake
3,242,928 A * 3/1966 Peters ..... 401/273
3,256,894 A * 6/1966 Sherman ..... 401/188 R
4,154,371 A 5/1979 Kolaczinski et al.

FOREIGN PATENT DOCUMENTS

DE 8138264.2 U1 12/1981
EP 0171462 11/1984
GB 913371 * 12/1962 ..... 401/188
WO WO95/08934 4/1995

* cited by examiner

*Primary Examiner*—David J. Walczak
(74) *Attorney, Agent, or Firm*—Flehr Hohbach Test Albritton & Herbert LLP

(57) ABSTRACT

A pump for discharging doses of liquid, gel-like or viscous substances from a container, having a pump body made of a flexible and elastic material which can be squeezed together to form a suction vacuum and delivers the liquid via an outlet valve, which opens under overpressure. In order to provide a pump of the type mentioned, which is of simple construction and is at the same time self-priming, provision is made for the outlet valve to be configured as a valve plate which closes the pump body at the top, is molded integrally onto the latter, is convex in the delivery direction, and has an incision which forms the valve outlet in the form of a lip seal.

1 Claim, 7 Drawing Sheets

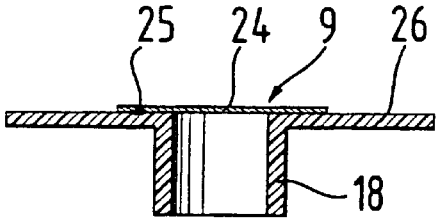
Fig. 7
Fig. 8
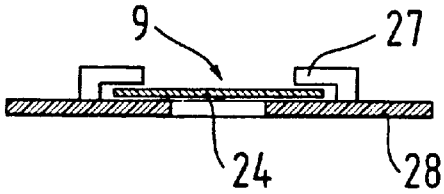
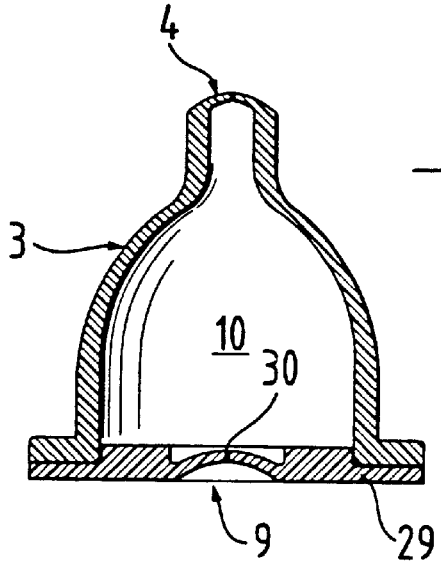
Fig. 9
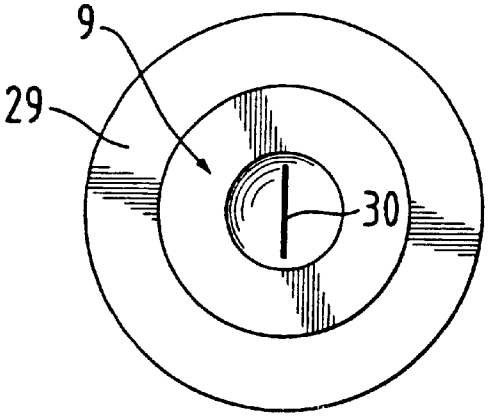
Fig. 10
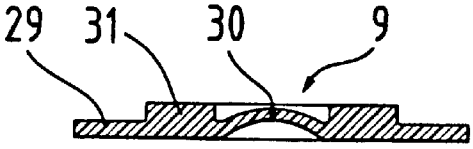
Fig. 11

PUMP FOR DISCHARGING DOSES OF LIQUID, GEL-LIKE OR VISCOUS SUBSTANCES

This application is a division of Applicant's earlier filed application Ser. No. 09/254,770, filed May 14, 1999.

The invention relates to a pump for discharging doses of liquid, gel-like or viscous substances from a container according to the preamble of claim 1 and to a dispenser with such a pump.

In the field of cosmetics, pumps are often used for discharging lotions, creams, shampoos, toothpaste, perfumes, aftershaves, etc. These are generally piston pumps. Positive-displacement pumps are also used for toothpaste. Compared to piston pumps, positive-displacement pumps have the advantage of containing far fewer components and being less sensitive to abrasion.

The pump body which bounds a displacement space has a shape which, following compression, returns to the starting position on account of its own spring force restoring elasticity and, by means of the vacuum generated during the process, sucks up the substance contained in a container. Known pump bodies are configured as elastic balls, dome-like bodies or folding bellows.

A dispenser for free-flowing media is known from DE 81 38 264 U1 and has an elastically restoring squeezing head which is arranged on a dispenser housing and has a valve nozzle opening and in whose bottom there is provided an inlet valve at which an intake hose ends. The valve nozzle opening of the squeezing head consists of lips which move tightly together and close the nozzle opening. The squeezing head itself has a bellows-like structure. Reliable closing of the valve nozzle opening requires permanent restorability of the material used.

However, it has proved to be a disadvantage that the materials available for these types of pump bodies of positive-displacement pumps generally only provide limited restorability because they either undergo fatigue after multiple actuation, or because the elasticity is not sufficient to generate a large enough vacuum. Positive-displacement pumps are furthermore not self-priming, unless additional springs are used for the outlet valve and the inlet valve which may be present. The advantage of positive-displacement pumps specifically containing few components is thus lost.

A filled toothbrush is known from DE 36 03 475 C1, in whose toothbrush handle there is a space for a tooth-cleaning agent, and whose toothbrush head has a duct which leads from the space to an outlet opening in the region of the toothbrush bristles. Provided at the other end of the toothbrush handle is an actuating member for actuating a pumping device which is arranged between the space and the duct and has a valve whose closing direction faces the supply space. This pumping device is configured as a piston pump which delivers tooth-cleaning agent into the duct by means of a piston rod. Piston pumps of this type are susceptible to wear and require many components.

The object of the invention is therefore to provide a pump for the metered discharge of liquid, gel-like or viscous substances from a container, which pump is of simple construction and, at the same time, is self-priming.

As a result, a positive-displacement pump is provided, which is not only very inexpensive on account of the design of the outlet valve and its integral configuration on the pump body, but also operates reliably and in a self-priming manner.

The problem of self-priming is primarily a problem with the outlet valve, since it must be assured that, when the vacuum is built up, no air is sucked in via the outlet valve. In providing such assurance, it is preferable, of course, to save the cost of a spring-loaded valve.

By virtue of the fact that the outlet valve has successfully been incorporated integrally into the pump body, the outlet valve here not only closes tightly, but the pump is also self-priming because the valve plate, which is convex in the delivery direction, that is to say curved outward, with an incision forming the valve outlet in the form of a lip seal opens easily in the delivery direction, i.e. outward, but closes all the more tightly, the greater the pressure exerted in the opposite direction. Thus, when the compressed pump body builds up a vacuum, the suction arising on the valve plate will squeeze together the incision and thus the lip seal to be completely airtight. The substance contained in a container, i.e. the product mass, can be sucked out of the container. If, in contrast, the pump body is squeezed together, the substance sucked into a displacement space of the pump body can be discharged through the automatically opening incision. The small outward curvature causes a tendency of the outlet valve to open under increased pressure in the displacement space.

The closing function of the outlet valve is so reliable that an air vacuum remains fully intact even over several days. The valve seats otherwise required for an outlet valve are dispensed with completely. The outlet valve suffers fatigue far less readily than conventional valves and is therefore long-lasting.

In the case of toothpaste, cosmetic lotions, shampoos, conditioners and body creams of high viscosities, tests involving such pumps resulted in excellent suction and discharge performances. Liquid media, alcoholic liquids and aftershaves worked quite exceptionally well in conjunction with a standpipe which protrudes into a container.

The incision in the valve plate is preferably arranged centrally so that the closing forces act on the lip seal as evenly as possible.

The size of the valve plate is preferably adapted to the length of the lip seal, so that the incision then extends essentially over the width of the valve plate.

The pump body preferably comprises a pump outlet which is in the shape of a neck or stack and has the outlet valve at its free end, a sealing guide being provided for arrangement in a delivery duct of a dispenser head which can be fitted on top. The design of the valve plate as claimed in claim 6 is preferred, since this increases the speed of response and thus reduces the sluggishness as much as possible.

The shapes of the pump bodies ensure a high level of shape-related spring force restoring elasticity. A force of curvature present here results in the fact that a compressed pump body becomes erect again spontaneously when the pressure is relieved.

In the case of a pump body configured in a hood- or dome-like manner, said pump body may have uneven wall thicknesses, as explained in claim 9. If the upper part of the hood or dome has a less thick wall than the central and lower part, this results in the fact that the initial delivery is dispensed with less pressure being expended than for the delivery from the central and lower displacement space. For this purpose, the greater wall thickness in the central and lower part ensures that, when the central and lower displacement spaces are emptied, the strong restoring force prevailing there—on account of the greater wall thickness—allows the pump body to shoot back into the starting position spontaneously and carries the weaker upper part along with it. Weaker elasticity of an upper part of the pump body can thus be desirable in order to reduce the pressure necessary at the beginning to actuate the dispenser.

Preferred materials for the pump body and thus including the outlet valve are mentioned herein. It is possible to use silicone rubber here, which is advantageous because this material, in contrast to thermoplastics, is aromatight and, since it is heat-resistant, can also be sterilized.

The pump body may be provided with an inlet valve, as is customary in conjunction with airless and standpipe dispensers. Butterfly valves have the advantage of closing automatically and without spring loading. A particularly preferred inlet valve is mentioned which can be produced far more inexpensively since it has only one part and thus no costs for assembly.

The pump body furthermore provides the advantage that its dimensions can be selected as a function of the required delivery volume in one dispensing stroke. Metered discharge of specific substance volumes is thus possible in a simple manner. Preferred discharging volumes are within a range of between 10 mcl and 1000 mcl.

The squeezing-together of the pump body in a discharge device, in particular a dispenser, is preferably effected by means of an actuating element which imposes a circumferentially distributed pressure centrally on the pump body. Whenever the pump body is of hood or dome-shaped configuration and has an outlet projection in the shape of a neck or stack, exerting the pressure centrally on the outlet projection in the shape of a neck or stack should be avoided. In the case of spot-like central exertion of pressure, such a pump body tends to simply invert inward, which means that the pump body is only partly emptied. The spring restoring force from this inversion state is only slight.

A pressure distribution plate provides assurance that the pressure is exerted uniformly on the entire upper outer surface of the pump body without loading the pump body and possibly the stack-like projection protruding out of the hood or dome. The pump body can thus be squeezed together to form a flat disk. An extremely inexpensive and practical solution, in this case, is provided by integrating this pressure distribution plate in an actuating knob as a cross-shaped pressure element.

The surprising result was that exerting such a pressure over the entire area develops an exceptionally strong restoring force, even in pump bodies made of very soft materials. Consequently, even highly viscous media can be delivered reliably with the slightest finger pressure, if the dispenser operates as an airless system with a follow-on plunger. When using standpipes, consideration must be given to the fact that, in the case of viscous media, there are additionally friction forces in a standpipe which bind strong delivery forces. Consequently, in conjunction with standpipes and media of higher viscosity, the pump body should have a high restoring force based on the shape and material.

The dispenser and thus the actuating element acting on the pump body can be actuated by finger pressure by means of an actuating knob or by means of a dispenser head which can be displaced axially in relation to the pump body.

The pump may be installed in any desired discharge devices. An area of application includes dispensers for substances of the cosmetics industry mentioned at the beginning. The pump can also be incorporated in a manual or electric toothbrush.

Further configurations of the invention emerge from the following description and the subclaims.

The invention is explained in greater detail below with reference to the exemplary embodiments illustrated in the attached figures, in which FIG. 1 shows a schematic longitudinal section through a dispenser system with a container and with a pump according to a first exemplary embodiment, airless with follow-on plunger;

FIG. 7 shows a schematic longitudinal section through an inlet valve of the pump according to FIGS. 1 to 4, butterfly valves FIG. 8 shows a schematic longitudinal section through a further exemplary embodiment of an inlet valve, butterfly valve with valve cage;

FIG. 9 shows a schematic longitudinal section through a pump according to FIGS. 5 and 6 with a further exemplary embodiment of an inlet valve with a lip seal;

FIG. 10 shows the pump according to FIG. 9 schematically from above;

FIG. 11 shows a schematic longitudinal section through the inlet valve of the pump according to FIGS. 9 and 10;

Figure 1:
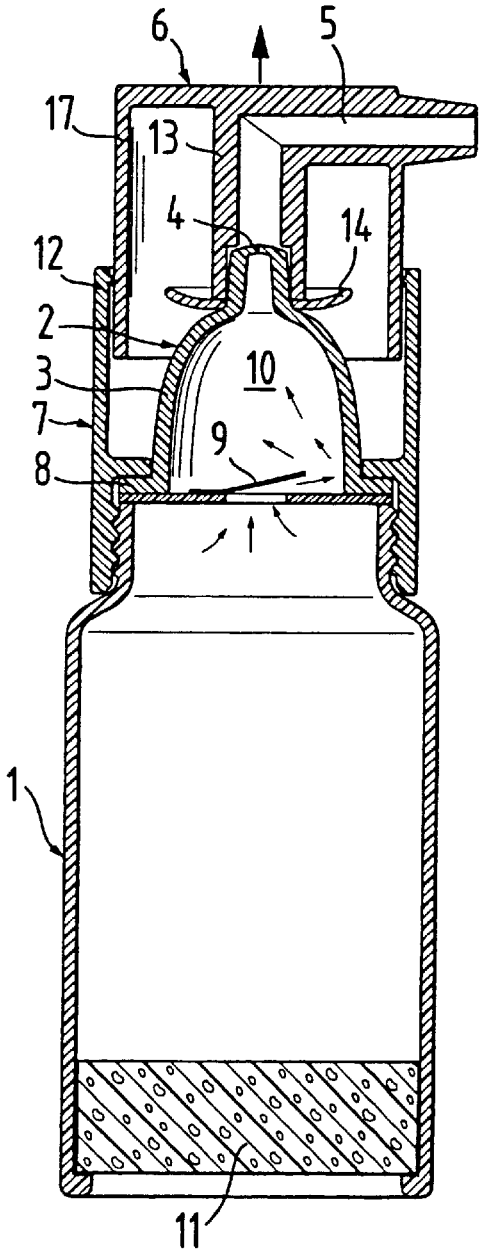

FIG. 1 shows a first exemplary embodiment of an airless dispenser system for discharging doses of flowable media, in particular liquid, gel-like or viscous substances, from a container 1 with a positive-displacement pump 2 as a suction discharge device, by means of which a vacuum-driven material lift is produced. To develop a suction vacuum, the positive-displacement pump 2 comprises a compressible pump body 3 made of a flexible and elastic material. On the output side, the pump body 3 has an outlet valve 4 which opens under overpressure and, in relation to a delivery duct 5 of a dispenser head 6, opens and closes so that the positive-displacement pump 2 delivers the liquid into said delivery duct 5.

The positive-displacement pump 2 is fitted into a pump housing 7 which is releasably attached to an upper edge of the container 1. In this case, a screw closure is provided for the releasable attachment. Alternative closures may be used such as, for example, a bayonet or snap-in closure or even a crimp variant with a ferrule. By means of the pump housing 7, the pump body 3 is arranged seated snugly above the opening of the container 1. For this purpose, the pump body 3 may have a sealing washer 8 at the bottom.

Furthermore, on the inlet side, the pump body 3 may be assigned an inlet valve 9 which opens and closes a displacement space 10 on the inlet side. Such an inlet valve 9 may be dispensed with, if a following piston 11, provided in the container 1, is secured against being pushed back by means of a pawl (not illustrated).

Figure 15:
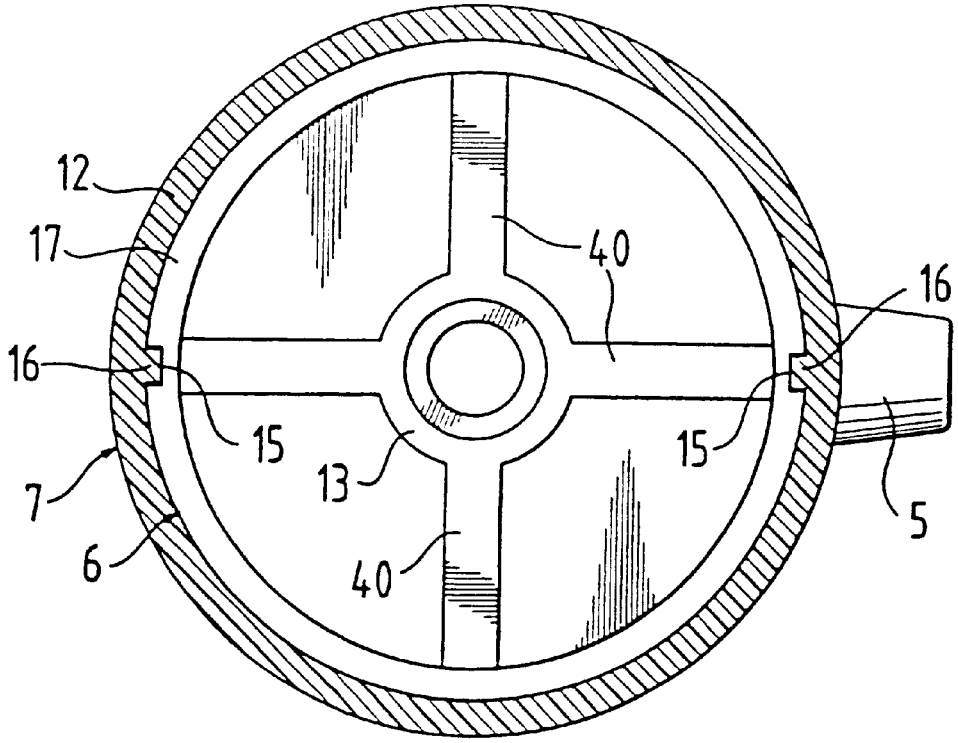
FIG. 15 shows a pump housing according to FIG. 13 in a plan view from above.

The pump housing 7 comprises an axially extending pump-housing guide sleeve 12 which has a screw-thread at the bottom for attachment to the container 1. This pump-housing guide sleeve 12 leaves enough free space on the right and left of the pump body 3 to allow the latter to be squeezed together in the manner of a disk, as illustrated, for example, in FIG. 4. The pump housing 7 furthermore guides the dispenser head 6 which can be displaced axially in relation to the pump housing 7, in that the dispenser head 6 is at least partially displaceable in the pump housing 7 by means of a dispenser-head guide sleeve 17, so that an actuating plunger 13, provided on the dispenser head 6, can squeeze the pump body 3 together by means of an actuating element 14 provided on said actuating plunger. For the axially displaceable guiding of the dispenser head 6 in the pump-housing guide sleeve 12, the latter may have one or more tongues 15 (FIG. 15) which interact with grooves 16 in a dispenser-head guide sleeve 17. Of course, the arrangement of tongue and groove may also be reversed.

Figure 3:
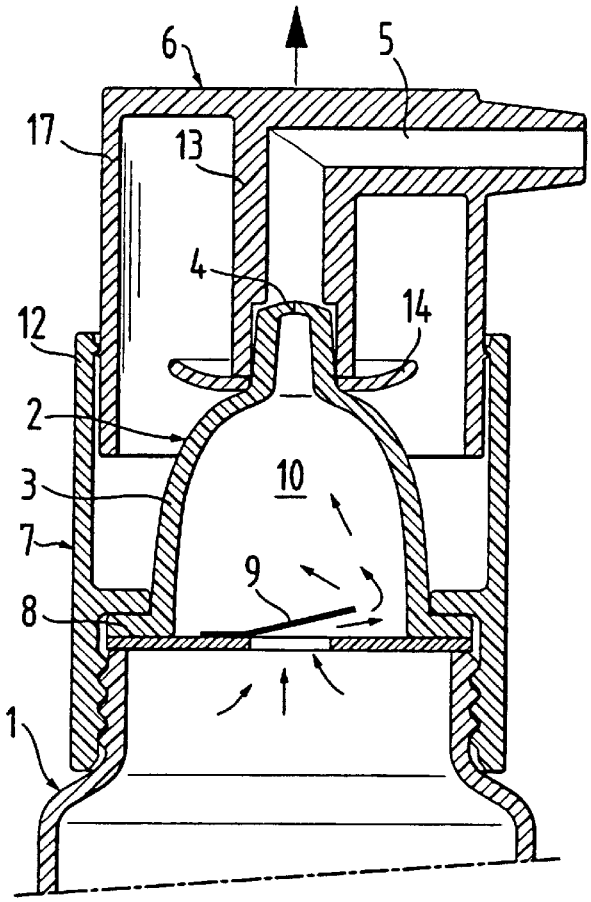
FIG. 3 shows a schematic longitudinal section through a dispenser head with a pump according to FIG. 1, in the position of rest.
Figure 4:
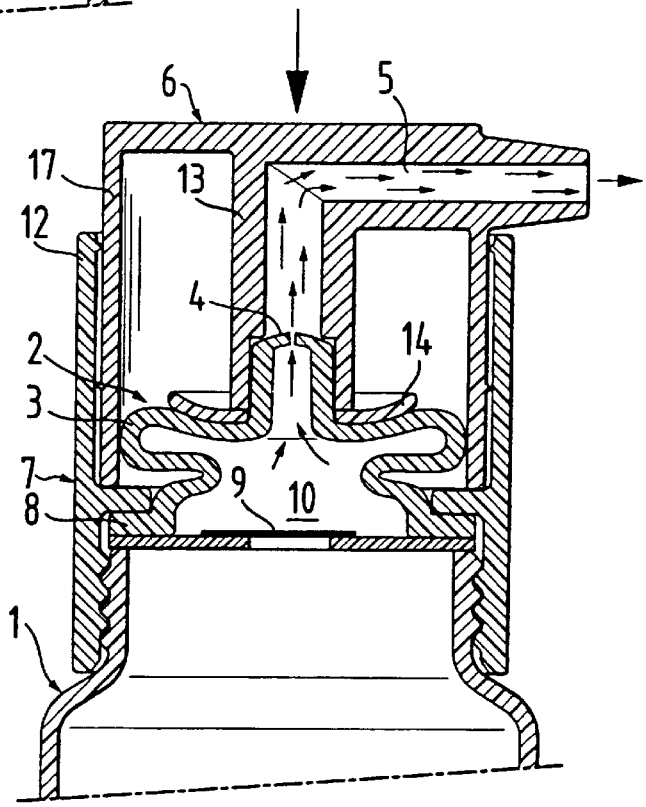
FIG. 4 shows a schematic longitudinal section through a dispenser head according to FIG. 1 in a working position.

The dispenser illustrated in FIG. 1 operates with an automatically adjusting follow-on plunger 11 and is thus a so-called airless dispenser. FIGS. 3 and 4 show the dispenser head 6 together with the pump housing 7 and the positive-displacement pump 2, on the one hand in the starting position or deactivated position (FIG. 3) and an activated position (FIG. 4) in which the pump body 3 is at least partially squeezed together. The design of the positive-displacement pump 2 will be described in detail below, in particular with reference to FIGS. 5 to 11.

Figure 2:
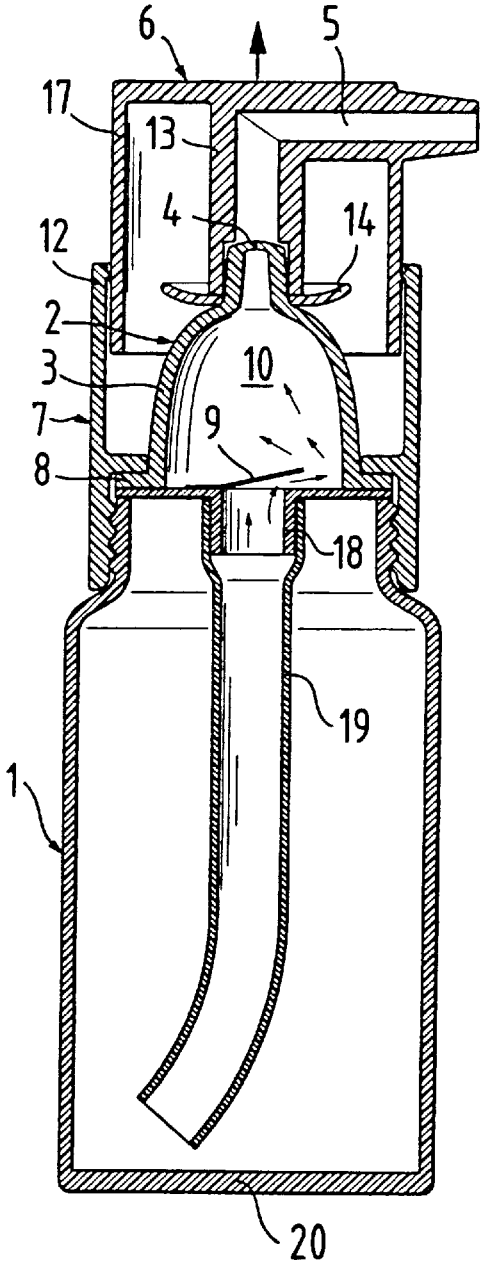
FIG. 2 shows a schematic longitudinal section through a dispenser system with a container and a pump according to a second exemplary embodiment, with a standpipe.

The dispenser illustrated in FIG. 2 differs from the dispenser described and illustrated in FIG. 1 only by the fact that this one has a container 1 with a fixed bottom 20, and a standpipe 19 is provided, which is connected to the inlet valve 9 using a standpipe adapter 18.

FIGS. 1 to 4 each show a pump fitted into a dispenser with a pump body 3 in which the outlet valve 4 is configured as a valve plate 21 (FIGS. 5, 6) which closes the pump body 3 at the top and is molded integrally onto the latter. The valve plate 21 is convex, i.e. curved outward, in the delivery direction and has an incision 22 (FIG. 5) which forms the valve outlet in the form of a lip seal. Specifically, this design can be seen in FIGS. 5 and 6 which show the outlet valve 4 in conjunction with a particular shape of the pump body 3 with different wall thicknesses.

The valve plate 21 preferably has a centrally arranged incision. Furthermore, the incision 22 preferably extends essentially over a width of the valve plate 21. The valve plate 21 is preferably configured to be thin in the manner of a membrane. Furthermore, the valve plate 21 preferably has only a slight degree of curvature. The thickness of the valve plate 21 is within a range of about 0.5 to 1 mm for valve-plate sizes of 3 to 6 mm. The thickness of the valve plate 21 can be adapted individually to the respective substance to be delivered. The incision 22 is usually produced by applying a cut through the center of the valve plate 21. The two cut sides form lips which bear against one another, closing tightly, when the pump is sucking, and open by spreading apart when the pump body is emptying under pressure.

The pump body 3 has a design with a shape-related spring restoring force from a compressed state to an original state. In this case, the pump body 3 is configured in a hood- or dome-like manner with a circular basic shape. Alternatively, an oval basic shape may also be provided. Furthermore, the pump body 3 preferably tapers at the top. In particular, the pump body 3 may end at the top in a pump outlet 23 which is in the shape of a nipple, neck or stack and on which is configured the valve plate 21 which closes the pump body 3 at the top. Such a pump outlet 23 provides a sealing guide for an engagement position with a discharge device, as can be seen in FIGS. 1 to 4. Alternatively, however, the sealing guide may also be carried out by a sealing ring (not illustrated) which is provided on the pump body 3 and surrounds the valve plate 21. A sealing seat of the pump body 3 in the delivery duct 5 is thus ensured.

Figure 5:
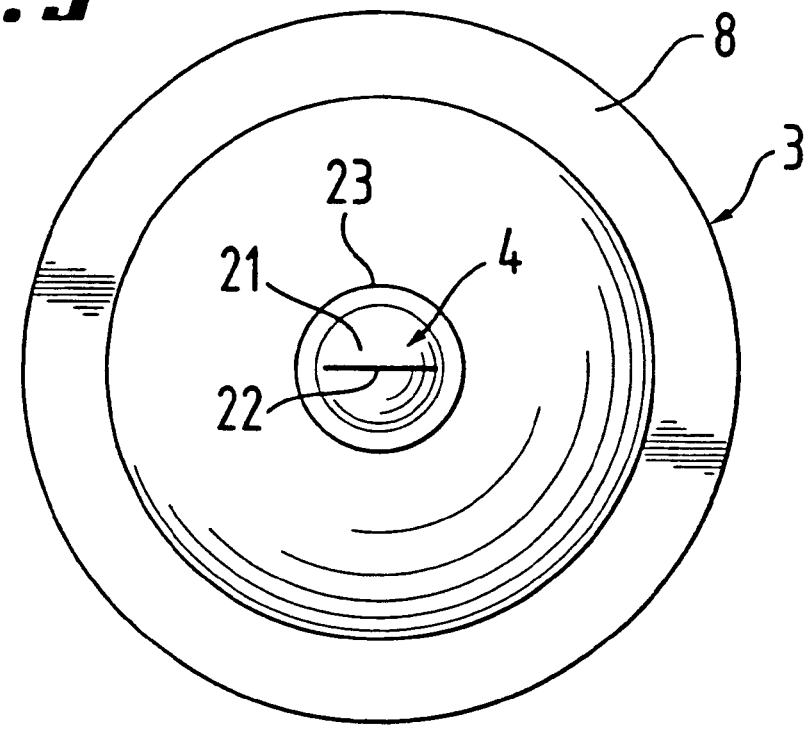
FIG. 5 shows a pump in a schematic plan view.
Figure 6:
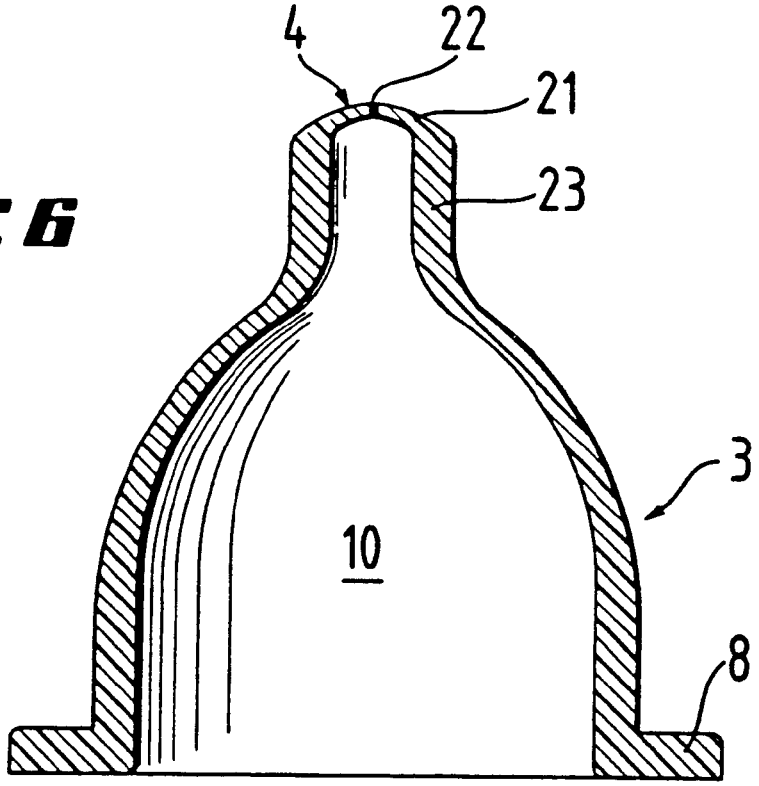
FIG. 6 shows a schematic longitudinal section through a pump according to FIG. 5.
Figure 12:
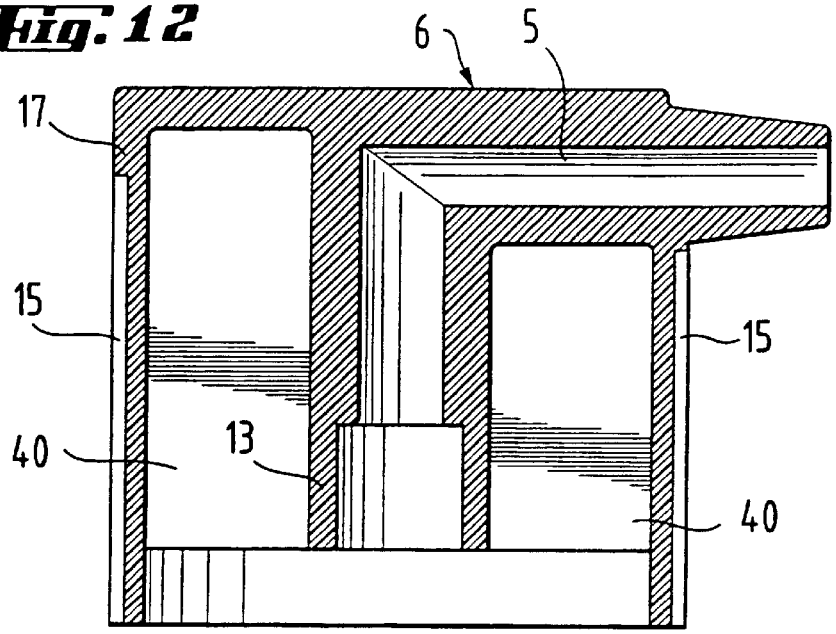
FIG. 12 shows a schematic longitudinal section through an actuating knob according to a further exemplary embodiment of the dispenser head with a set-back cross-shaped pressure plate.
Figure 13:
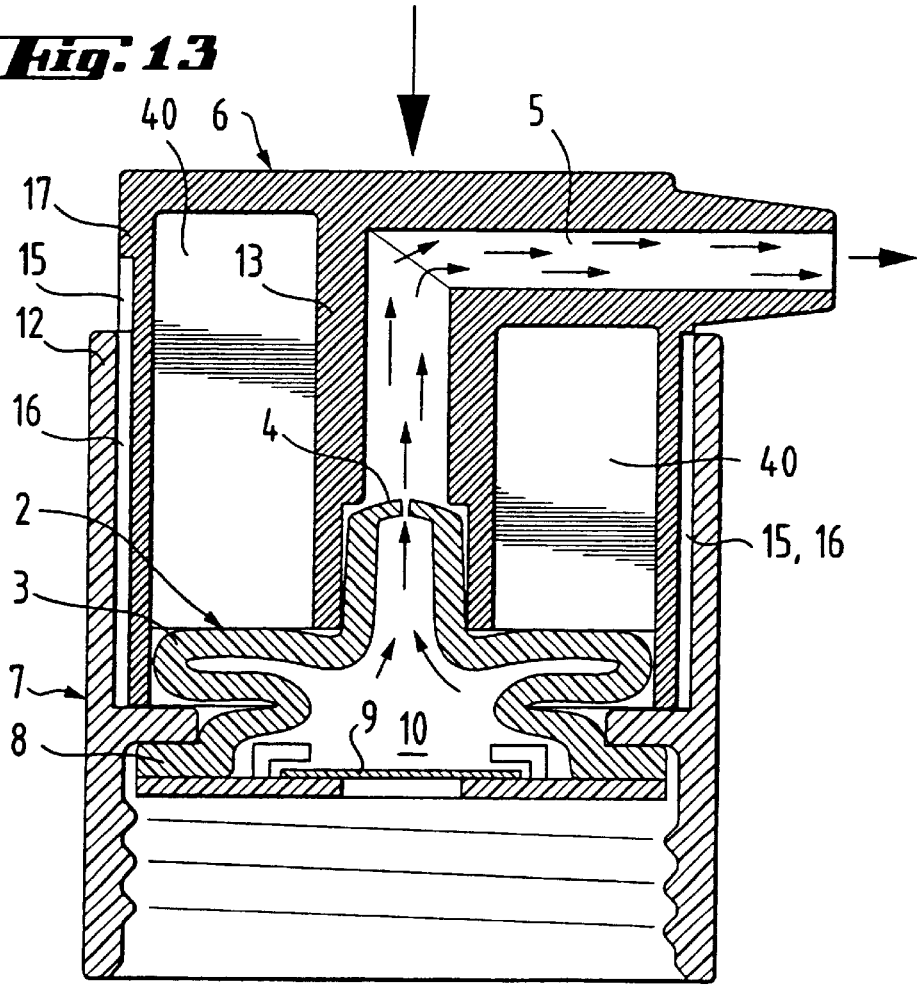
FIG. 13 shows a schematic longitudinal section through a dispenser head with a pump in the activated state according to a further exemplary embodiment with a cross-shaped pressure plate.
Figure 14:
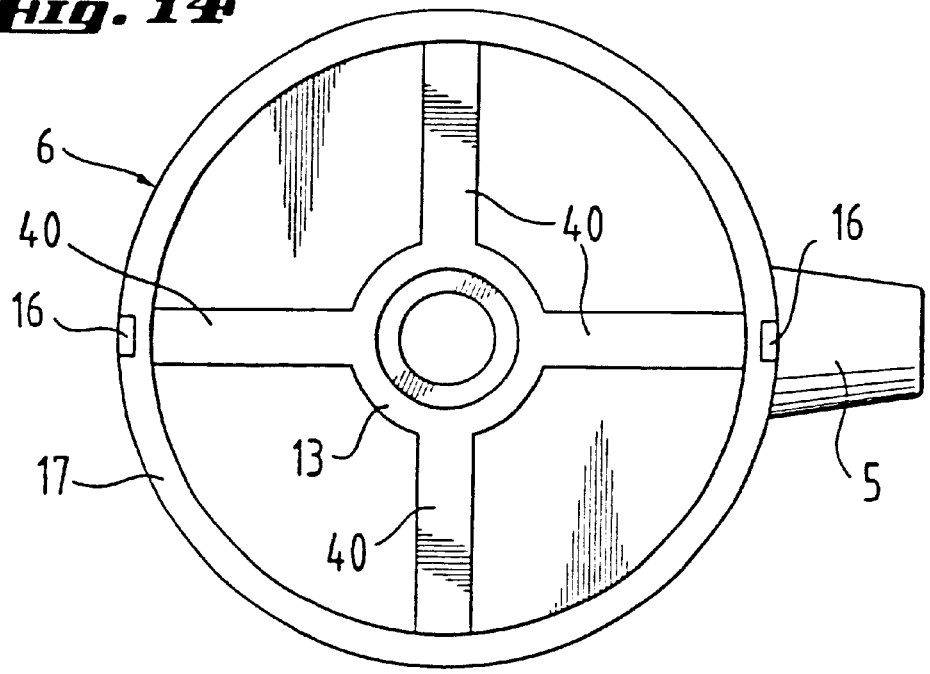
FIG. 14 shows a schematic cross section of the actuating knob.

As illustrated in the exemplary embodiment according to FIGS. 5 and 6, the hood- or dome-like pump body 3 may be configured with different wall thicknesses. The wall thickness in an upper portion is preferably less than in a central and lower portion. The upper part may have, for example, only half the thickness of the central and lower part.

The valve plate 21 may have a round or polygonal shape. A further shape of the pump body 3, mentioned as an example, is that of a pump bellows.

Preferred materials for the pump 2 are thermoplastic polyester elastomers, in particular styrene butylene styrene (SBS), styrene ethylene butylene styrene (SEBS) or block copolymer. Other preferred flexible and elastic materials are natural rubber or silicone rubber of a Shore A hardness of 30 to 80, in particular a 60 to A 80.

The inlet valve 9 may be formed by a butterfly valve in which, according to FIG. 7, a butterfly flap 24 is fixed on a sealing washer 26 by means of a weld/adhesive connection 25. An alternative design of the inlet valve 9 is shown in FIG. 8, where the butterfly flap 24 of a butterfly valve is arranged in a valve disk cage 27 of a sealing washer 28.

FIGS. 9 to 11 show a further embodiment of the inlet valve 9. The inlet valve 9 is formed by a valve plate 29 which closes an inlet of the pump body 3, is convex in the delivery direction, and has an incision 30 which forms the valve inlet in the form of a lip seal. The valve plate 29 preferably has a peripheral reinforcement 31 which extends at the edge of the displacement space 10.

The dimensions of the pump body 3 can be selected as a function of the required metering volumes for substance volumes from 10 mcl to 1000 mcl, in particular 50 mcl to 1000 mcl.

The actuating element 14 illustrated in FIGS. 1 to 4 is designed in such a way that, when the pump is actuated, a pressure distributed circumferentially is exerted on a top side or the side walls of the pump body 3, said side walls extending laterally in relation to the actuating plunger 13. In this case, the actuating element 14 is a pressing disk which squeezes the pump body 3 together in the manner of a disk when the dispenser head 6 is depressed.

In the exemplary embodiments illustrated in FIGS. 12 to 15, the actuating element 14 is a pressure distribution plate which is incorporated integrally into the dispenser head 6 and has a cross-shaped pressure element 40.

The positive-displacement pump 2 described above can be fitted in a large number of discharge devices. The dispensers described above from the cosmetics sector are only one application.

Figure 16:
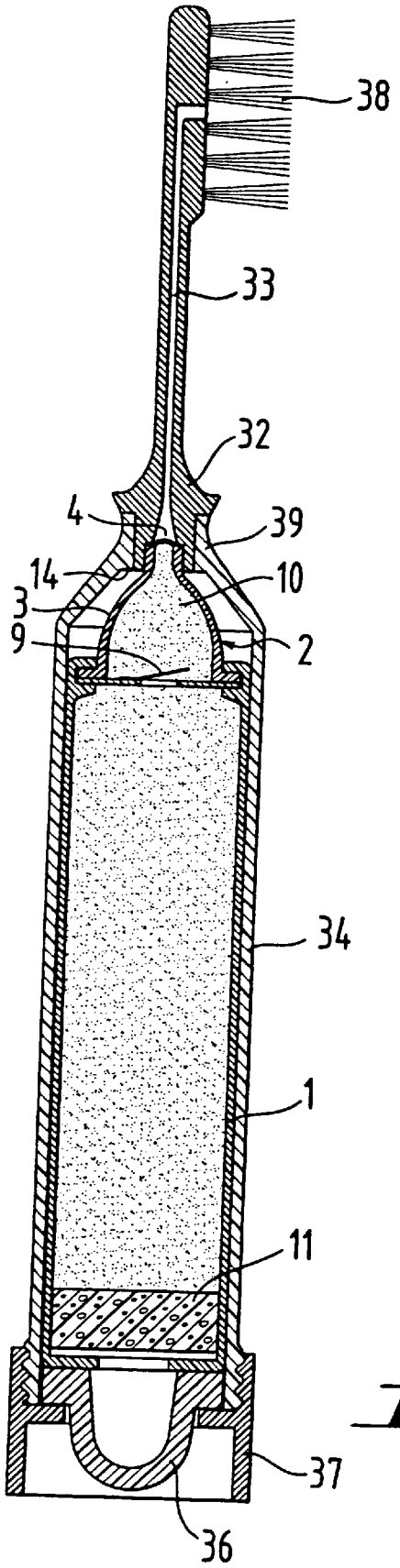
FIG. 16 shows a schematic longitudinal section through a toothbrush with an integrated pump in the airless system.
Figure 17:
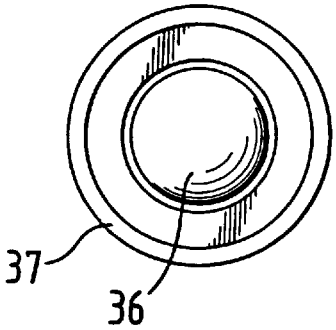
FIG. 17 shows a schematic bottom view of the toothbrush according to FIG. 16.

FIGS. 16 and 17 show a toothbrush into which the pump 2 is incorporated. In this case, the pump 2 delivers a substance into a delivery duct 33 of a toothbrush head 32 which may be configured as an exchangeable attachment. The pump 2 can be inserted, together with the container 1, as a cartridge into a hollow toothbrush handle 34. To actuate the pump 2, either the toothbrush head 32 can be displaceable in relation to the hollow toothbrush handle 34, or an actuating knob 36 may be provided at the bottom, which knob can be attached by means of a screw cap 37. The positive-displacement pump 2 is seated with its outlet valve 4 snugly in a toothbrush neck 39 on which the actuating element 14 for squeezing the pump body 3 together is provided in an integral manner.

By pressing in the actuating knob 36, the product located in the displacement space 10 of the positive-displacement pump 2 is squeezed out via the outlet valve 4 into the delivery duct 33 and delivered to a toothbrush head 38. When the temporary pressure is discontinued, the pump body 3 assumes its original shape again. The vacuum then forming therein brings about automatic adjustment of the follow-on plunger 11 in the container 1. The inlet valve 9 of the positive-displacement pump 2 closes during the squeezing-out phase, while the outlet valve opens under pressure. When the pressure on the actuating knob 36 is discontinued, the outlet valve 4 closes and prevents air from entering the displacement space 10, while the inlet valve opens under the developing vacuum and delivers product into the pump body. This operation can be repeated until the container 1 is empty.

What is claimed is:

1. A toothbrush comprising a hollow toothbrush handle into which a replaceable cartridge can be inserted and a toothbrush head seated on top of the toothbrush handle, said cartridge comprising a container containing a flowable dental care media, and a pump for discharging doses of the flowable media, said pump comprising a pump body being made of a flexible and elastic material and being configured in a dome-like manner to define an outlet chamber for storing said media received from said container for subsequent delivery, having a centrally located nipple on top of which an outlet valve is formed, wherein the outlet valve is configured as a valve plate which is convex in the delivery direction and has an incision which forms a valve outlet in the form of a lip seal, and having an inlet valve closing the outlet chamber during squeezing while the outlet valve opens under pressure;

said toothbrush head comprising a delivery conduit into which the nipple of the pump is insertable to snugly seat the outlet valve in the toothbrush head, and an actuating element imposing around the nipple a circumferentially distributed pressure on the pump body for squeezing together the pump body to cause said incision to open and to deliver the media located in the outlet chamber to the toothbrush head at an opposite end of the delivery conduit.

* * * * *